US006844503B2

(12) United States Patent
Thornley et al.

(10) Patent No.: US 6,844,503 B2
(45) Date of Patent: Jan. 18, 2005

(54) HELICAL SHED

(75) Inventors: David William Maute Thornley, Minety (GB); Stephen Andrew Clift, Fairford (GB); Alan Cook, Dorset (GB)

(73) Assignee: Tyco Electronics U.K. Limited (GB)

( * ) Notice: Subject to any disclaimer, the term of this patent is extended or adjusted under 35 U.S.C. 154(b) by 0 days.

(21) Appl. No.: 10/479,193

(22) PCT Filed: Jun. 25, 2002

(86) PCT No.: PCT/GB02/02922

§ 371 (c)(1),
(2), (4) Date: Dec. 23, 2003

(87) PCT Pub. No.: WO03/003383

PCT Pub. Date: Jan. 9, 2003

(65) Prior Publication Data

US 2004/0168823 A1 Sep. 2, 2004

(30) Foreign Application Priority Data

Jun. 29, 2001 (GB) ..... 0116135

(51) Int. Cl.[7] ..... H01B 17/06

(52) U.S. Cl. ..... 174/179; 174/177; 29/729; 29/887

(58) Field of Search ..... 174/176–179, 174/181, 195, 196, 209; 29/729, 887

(56) References Cited

U.S. PATENT DOCUMENTS

| | | | | | |
|---|---|---|---|---|---|
| 3,338,768 | A | * | 8/1967 | Kuhl | 174/209 |
| 3,484,938 | A | * | 12/1969 | Sauer | 29/887 |
| 3,971,128 | A | * | 7/1976 | Rebosio | 29/887 |
| 4,181,486 | A | | 1/1980 | Saito | 425/113 |
| 4,833,278 | A | * | 5/1989 | Lambeth | 174/139 |
| 4,867,667 | A | | 9/1989 | Moriyama | 425/190 |
| 5,019,309 | A | | 5/1991 | Brunnhofer | 264/103 |
| 5,885,680 | A | * | 3/1999 | Levillain et al. | 428/60 |
| 5,925,855 | A | * | 7/1999 | Denndorfer | 174/179 |
| 5,973,272 | A | | 10/1999 | Levillain et al. | 174/179 |

FOREIGN PATENT DOCUMENTS

| | | | | |
|---|---|---|---|---|
| CA | 2 046 682 | | 2/1992 | |
| CH | 659907 | A5 * | 2/1987 | H01B/17/32 |
| EP | 0 293 270 | | 11/1988 | |
| FR | 2054863 | | 4/1971 | |
| GB | 2079069 | A * | 1/1982 | H01B/17/00 |
| GB | 2186520 | | 8/1987 | |
| JP | 60257223 | | 12/1985 | |
| JP | 62103125 | | 5/1987 | |
| JP | 11165340 | | 6/1999 | |
| WO | 85/02053 | | 5/1985 | |

OTHER PUBLICATIONS

International Search Report for PCT/GB 02/02922.
Great Britain Search Report for GB 0116135.5.
International Preliminary Examination Report for PCT/GB 02/02922.

* cited by examiner

*Primary Examiner*—Dean A. Reichard
*Assistant Examiner*—Adolfo Nino
(74) *Attorney, Agent, or Firm*—Myers Bigel Sibley & Sajovec

(57) ABSTRACT

A method of providing a shed (2) for a high-voltage insulator (1) includes providing a substantially tubular substrate (3), providing an extruder (10) having an extruder head (11) defining an extrusion direction (A), using the extruder (10) to extrude the shed (2) and applying the shed (2) on the substrate (3) while rotating the substrate relative to the extruder head (11). The extrusion direction (A) substantially coincides with the longitudinal axis of the substrate (3), and the substrate (3) is fed through the extruder head (11).

20 Claims, 2 Drawing Sheets

HELICAL SHED

RELATED APPLICATIONS

The present application is a National Phase application of PCT/GB02/02922 filed on Jun. 25, 2002 and published in English, which claims priority from Application GB 0116135.5 filed on Jun. 29, 2001.

FIELD OF THE INVENTION

BACKGROUND OF THE INVENTION

High voltage components and devices, such as insulators, surge arresters and cable terminations may be provided with one or more sheds to increase the tracking length. Tracking is the well-known phenomenon of leakage currents flowing over the outer surface of the component. Lengthening the leakage path increases its resistance and thereby reduces the current and any surface deterioration caused by the leakage current. In this context, the term high voltage is understood to include voltages of more than 400V, in particular more than 1000V, and especially more than 5000V.

Traditionally, several individual ring-shaped sheds are arranged on the outer surface of a high-voltage component. The sheds may be heat-shrinkable, as disclosed in International Patent application WO 94/29886 (Raychem). The sheds may be combined into a single component, as disclosed in U.S. Pat. No. 5,389,742 (Raychem). In all these arrangements, the sheds constitute an array of approximately ring-shaped elements. In contrast, U.S. Pat. No. 4,833,278 (Hydro-Quebec) discloses an essentially helical shed made up of several joined shed segments. The above-mentioned U.S. Pat. No. 5,973,272 suggests to wind a single T-shaped shed element around a tube so as to provide an uninterrupted helical shed. The T-shaped element can be continuously extruded by an extruder the head of which is arranged at approximately a right-angle relative to the tube. The T-shaped shed element can be wound around the tube as it is being extruded, allowing a single component to be provided with a helical shed in one single process step. Although the process of U.S. Pat. No. 5,973,272 is very advantageous, the use of a T-shaped structure necessarily limits the bend radius of the helical shed. For this reason, this known process is not suitable for components having a relatively small diameter. In addition, the mutual sealing of adjacent windings of the T-shaped shed element cannot be guaranteed. As a result, dirt may accumulate in any gap between the windings and may decrease the surface resistance of the component, thereby causing an increased amount of tracking or water may penetrate the seal and cause electrical failure in the substrate. Another process, described in WO-A-99/10896, similarly uses transverse extrusion of the shed, resulting in bond lines between adjacent turns of the shed.

SUMMARY OF THE INVENTION

It is therefore an object of the present invention to eliminate the disadvantages of the Prior Art and to propose a method of providing a helical shed which is also suitable for high-voltage components having a relatively small diameter.

It is another object of the present invention to propose a method of providing a helical shed which allows a continuous production process over great lengths.

It is still another object of the present invention to propose a method of providing a helical shed which ensures an excellent sealing of the component.

It is yet another object of the present invention to propose a high-voltage component provided with a helical shed.

Accordingly, a method as defined in the preamble is according to the present invention characterised in that the extrusion direction substantially coincides with the longitudinal axis of the substrate, and in that the substrate is fed through the extruder head.

In spite of the apparently "wrong direction" of this longitudinal shed extrusion, compared with the known transverse extrusion methods, the present invention ingeniously and unexpectedly produces a satisfactory helical shed directly and continuously applied on the substrate. In addition, an integral sleeve covering the substrate can be co-extruded, thus environmentally sealing the substrate without bond lines between adjacent turns of the shed.

As the helical shed of the present invention is extruded as a curved part, it is possible to obtain much smaller diameters than with the wound sheds of the Prior Art which are extruded as straight parts.

In a preferred embodiment of the present invention the substrate is rotated while the extruder and extruder head are stationary. Alternatively, the extruder head could rotate while the substrate is (rotationally) stationary, or possibly both the substrate and the extruder head could be rotated. A stationary "cross head" type extruder is preferred.

The substrate may comprise a fibreglass rod, a plastic tube or the like. The shed material may comprise a silicone resin, a polyolefin and/or other suitable materials. The substrate may have a diameter of between 1 and 10 cm, preferably between 1.5 and 5 cm.

It is noted that a helical shed suitable for a high-voltage insulator is generally also suitable for other high-voltage devices and components, such as surge arresters, cable terminations, etc.

The present invention further provides a high-voltage component, such as a high-voltage insulator or a high-voltage surge arrester provided with a helical shed produced by the method defined above, and a sleeve comprising a helical shed produced by the method defined above.

The present invention will further be explained below with reference to the accompanying drawings, in which:

DETAILED DESCRIPTION OF EMBODIMENTS OF THE INVENTION

Figure 1:
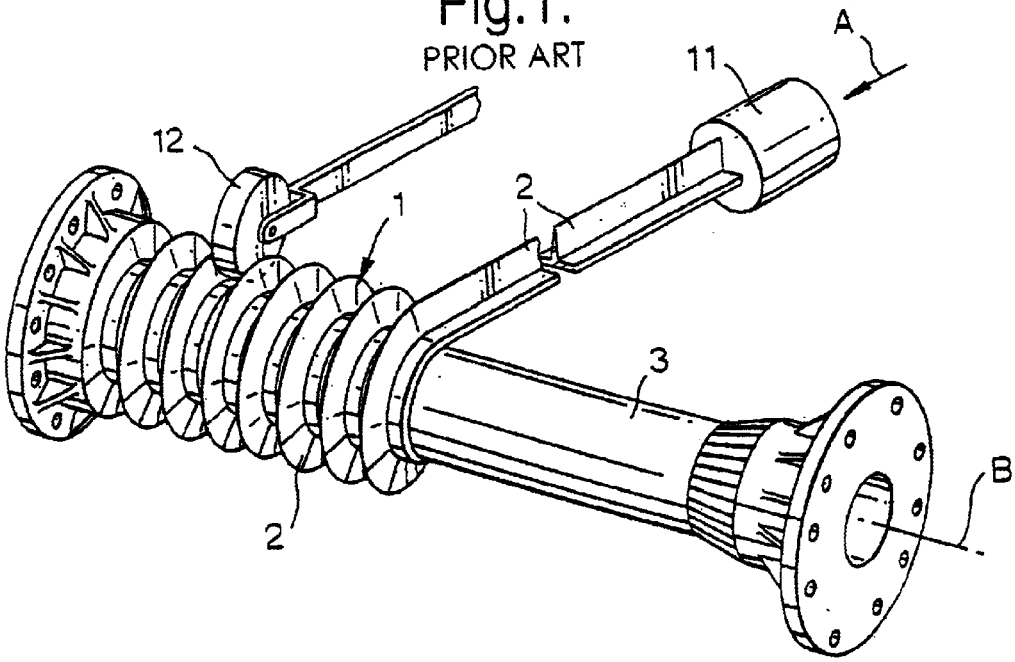
Fig.1. PRIOR ART
FIG. 1 schematically shows, in perspective, the production of a helical shed according to the Prior Art.

The method of producing a helical shed according to U.S. Pat. No. 5,973,272 is schematically shown in FIG. 1. An extruder head 11 produces a shed 2 in the form of a substantially T-shaped strip which is wound around a rotating substrate (high-voltage insulator) 3. The base of the strip is pressed onto the substrate by a pressure wheel 12. The adjacent windings of the base of the strip form a sleeve 4 which substantially covers the outer surface of the substrate 3.

The extruder head 11 is orientated such that the extrusion direction A is substantially perpendicular to the longitudinal direction and rotational axis B of the substrate 3. As can be seen from FIG. 1, the initially straight strip is bent around the substrate. Due to its T-shape, the bend radius is necessarily limited.

Figure 2:
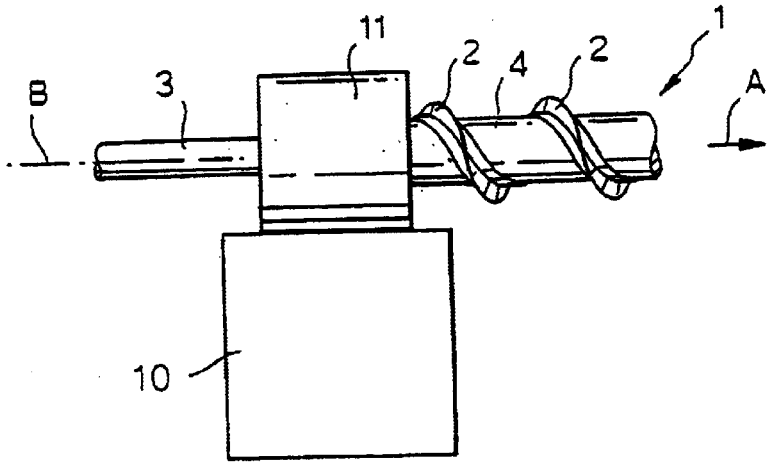
FIG. 2 schematically shows, in top view, the production of a helical shed according to the present invention.
Figure 3:
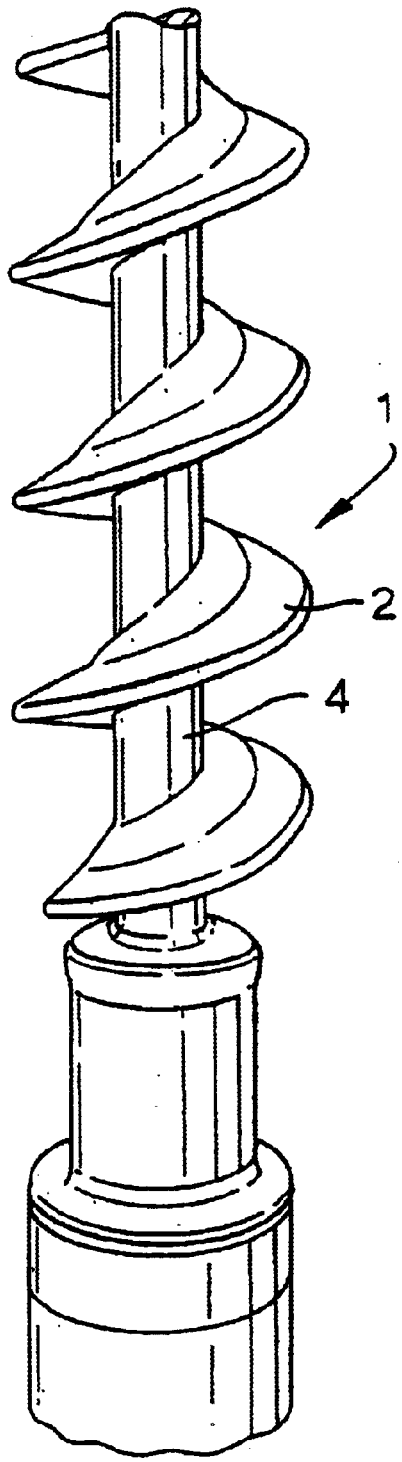
FIG. 3 shows a high-voltage insulator provided with a helical shed according to the present invention.

The method of producing a helical shed according to the present invention is schematically shown in FIG. 2. A substrate 3 is inserted into the head 11 of an extruder 10. The substrate, which may be a fibreglass rod, is rotated about its longitudinal axis B by rotating means (not shown) which may be integral with the extruder head 11 and which also advance the substrate 3 through the head 11. The extruder applies a continuous sleeve 4 onto the substrate 3, a helical shed 2 protruding from the sleeve 4. The resulting structure may be used as a high voltage insulator 1, such as shown in FIG. 3.

As shown in FIG. 2, the extrusion direction A coincides with the longitudinal axis B of the substrate. The combination of co-axial extrusion and rotation allow a helical shed to be readily applied in a single process step.

It is possible to use an auxiliary substrate having a smooth surface, such as a tube comprising TEFLON®, to first extrude the sleeve onto the auxiliary substrate. The sleeve can be removed from the auxiliary substrate and can then be applied on another substrate. The auxiliary substrate may be reusable.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. A method of providing a helical shed (2) for a high-voltage insulator, the method comprising:

providing a substantially cylindrical substrate;

providing an extruder having an extruder head defining an extrusion direction;

using the extruder to extrude the shed and a continuous sleeve; and applying the shed and the continuous sleeve on the substrate while rotating the substrate relative to the extruder head with the continuous sleeve substantially covering the substrate; and wherein the extrusion direction substantially coincides with the longitudinal axis of the substrate, and in that the substrate is fed through the extruder head.

2. A method according to claim 1, wherein the substrate is rotated.

3. A method according to claim 1, wherein the extruder head is rotated.

4. A method according to claim 1, wherein the substrate comprises a fibreglass rod.

5. A method according to claim 1, wherein the shed material comprises a silicone resin and/or a polyolefin.

6. A method according to claim 1, wherein the substrate has a diameter of between 1 and 10 cm.

7. A method according to claim 1, wherein the continuous sleeve is integrally extruded with the helical shed.

8. A method according to claim 7, wherein after extruding the sleeve is removed from the substrate and is applied on another substrate.

9. A method according to claim 8, wherein the substrate is a rod or tube comprising TEFLON®.

10. A high voltage component, comprising a helical shed produced by the method of claim 1.

11. A high voltage component according to claim 10, comprising a high-voltage insulator.

12. A high voltage component according to claim 10, comprising a high-voltage surge arrester.

13. A high voltage component according to claim 10, comprising optical fibres for providing a data link.

14. A method for forming a high voltage component, comprising:

moving a longitudinally extending substrate through an extruder head; and extruding from the extruder head, in an extrusion direction substantially corresponding to the movement direction of the substrate, a shed and a continuous sleeve covering the substrate moving through the extruder head while rotating the substrate relative to the extruder head to form the high voltage component.

15. The method of claim 14 wherein rotating the substrate relative to the extruder head comprises rotating the substrate.

16. The method of claim 14 wherein the substrate comprises a fiberglass rod.

17. The method of claim 14 wherein the shed comprises a silicone resin and/or a polyolefin.

18. The method of claim 14 wherein the substrate has a diameter between about 1.5 centimeters (cm) and about 5 cm.

19. The method of claim 14 wherein the shed and the continuous sleeve are integrally extruded.

20. A high voltage component formed by the method of claim 14.

* * * * *